US006012195A

United States Patent [19]

Lindsay

[11] Patent Number: 6,012,195

[45] Date of Patent: Jan. 11, 2000

[54] APPLICATOR SYSTEM WITH INTERCHANGEABLE HEADS

[76] Inventor: James A. Lindsay, 1409 S. Temple Ave., Compton, Calif. 90221

[21] Appl. No.: 09/089,071

[22] Filed: Jun. 2, 1998

[51] Int. Cl.[7] ..... A47K 7/03

[52] U.S. Cl. ..... 15/222; 15/227; 15/104.94; 15/210.1

[58] Field of Search ..... 15/104.94, 160, 15/210.1, 222, 227, 244.1; 401/8

[56] References Cited

U.S. PATENT DOCUMENTS

| | | | |
|---|---|---|---|
| 1,260,175 | 3/1918 | Fjimori | 15/222 |
| 1,473,315 | 11/1923 | Poirier | 15/222 |
| 1,598,574 | 8/1926 | Gibson | 401/8 |
| 1,746,075 | 2/1930 | Edwards | 15/222 |
| 2,333,436 | 11/1943 | Novick | 15/222 |
| 2,408,676 | 10/1946 | Novick | 15/222 |
| 2,905,957 | 9/1959 | Volpe | 15/222 |
| 3,130,441 | 4/1964 | Hahn | 401/8 |
| 4,718,409 | 1/1988 | Gershov | 15/222 |

*Primary Examiner*—Randall E. Chin
*Attorney, Agent, or Firm*—Goldstein & Canino

[57] ABSTRACT

An applicator system with interchangeable heads. The system comprises a pair of strap handles which are capable of engaging any one of a variety of different attachment heads. Once engaged, the strap handles may be reciprocated back-and-forth across a region of the user's body so that the attachment head washes, massages or applies lotion to that region. The attachment head in the preferred embodiment has a pouch cavity so that, upon disengaging the attachment head from the strap handles, the user may insert his hand into the pouch cavity and independently employ the attachment head as a hand applicator.

2 Claims, 2 Drawing Sheets

APPLICATOR SYSTEM WITH INTERCHANGEABLE HEADS

FIELD OF THE INVENTION

The invention relates to an applicator system with interchangeable heads. More particularly, the invention relates to an applicator which accepts various configurations of applicator heads for applying soaps, lotions, skin creams, sun-blocks and the like to a user's body, thus permitting an individual to self apply such soaps, lotions, skin creams, sun-blocks, and the like to his or her body with ease and comfort, while at the same time scrubbing and massaging the intended area of application.

BACKGROUND OF THE INVENTION

The use of soaps, moisturizing creams, sun blocks and other lotions is well known and prevalent in today's commercial markets. Individuals generally are without an easy and effective means of applying these solutions to certain regions of their bodies, such as the rear lower back. Typically, these individuals will struggle unsuccessfully to reach the inaccessible portions of their back, resulting in an uneven and inadequate application, washing or massaging thereof. Attempts in the prior art to address this problem through the use of various applicators have proved ineffective. What is needed is an applicator which utilizes various interchangeable heads for applying various solutions, and permits the user to execute various stimulations such as wash, massage and scrub typically inaccessible regions of the body.

While the prior art units found heretofore may be suitable for the particular purpose employed, or for general use, they would not be as suitable for the purposes of the present invention as disclosed hereafter.

SUMMARY OF THE INVENTION

The present invention relates to an applicator which accepts various configurations of applicator heads for applying soaps, lotions, skin creams, sun-blocks and the like to a user's body, thus permitting an individual to self apply such soaps, lotions, skin creams, sun-blocks, and the like to his or her body with ease and comfort, while at the same time scrubbing and massaging the intended area of application.

In accordance with the invention, there is provided an applicator system with interchangeable heads which allows a user to wash, scrub, massage and stimulate all regions of the body with ease.

Further in accordance with the invention, there is provided an applicator system with interchangeable heads which allows a user to select from a variety of applicator heads according to the type of solution to be applied or the region of the body desired to be contacted.

Further in accordance with the invention, there is provided an applicator system with interchangeable heads which possesses quick-disconnect handles that may be removed and folded or rolled-up for easy storage and handling.

Further in accordance with the invention, there is provided an applicator system wherein every interchangeable head possesses a pouch pocket so that it may be used independently by inserting one's hand into the pouch pocket and employing said head as a hand applicator such as a standard washcloth.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
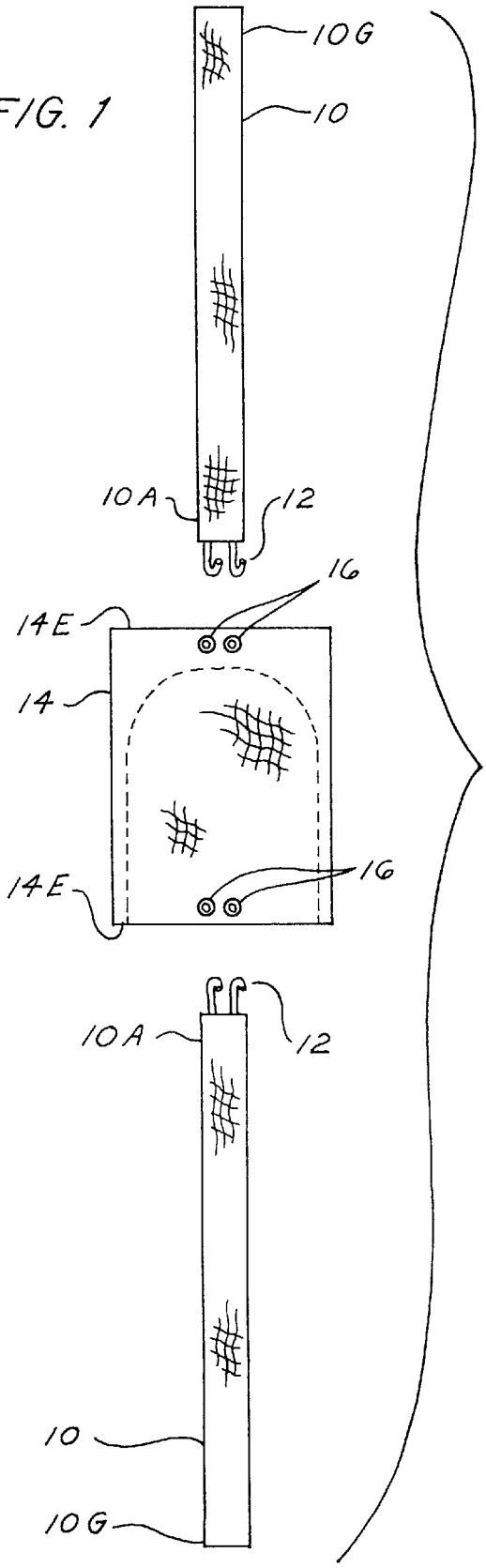
FIG. 1 is an exploded plan view of the applicator system with interchangeable heads of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the applicator system with interchangeable heads. The words "proximal end" and "distal end" refer, respectively, to ends of an object nearer to and further from the operator of the object when the object is used in a normal fashion or as is described in the specification.

FIG. 1 illustrates a plan view of the applicator system with interchangeable heads of the instant invention. As seen, the system comprises a pair of elongated strap handles 10, each of said elongated strap handles 10 having an attachment end 10A and a grasping end 10G. The elongated strap handles 10 are made of any suitable material which is soft to the touch, yet pliable enough so that said elongated strap handles 10 may be folded or rolled-up for convenient compact storage. Attachment means, such as hooks 12 are disposed upon the attachment end 10A of each of the elongated strap handles 10. While hooks 12 are illustrated in the referenced drawings, it should also be understood that any other attachment means known to those skilled in the art may be employed, such as snaps, buttons, hook-and-loop fastener (such as that commonly sold under the trade name VELCRO) or the like.

Also shown in FIG. 1 is an attachment head 14 having opposite ends 14E and 14E. The attachment head 14 shown comprises only one of many which may be utilized. For instance, the various interchangeable attachment heads 14 may comprise both solid and hollow configurations, said hollow embodiments capable of being filled with various lotions, soaps and the like. It is further contemplated that each attachment head 14 consist of cotton, terry-cloth, sponge, or any other suitable material commonly employed for personal hygiene, lotion application or stimulation. Regardless of the configuration of the interchangeable head which is employed, however, each is contemplated as having receiving means located at each of the opposite ends 14E for allowing the attachment means of the strap handles 10 to securely engage said interchangeable head 14.

Figure 2:
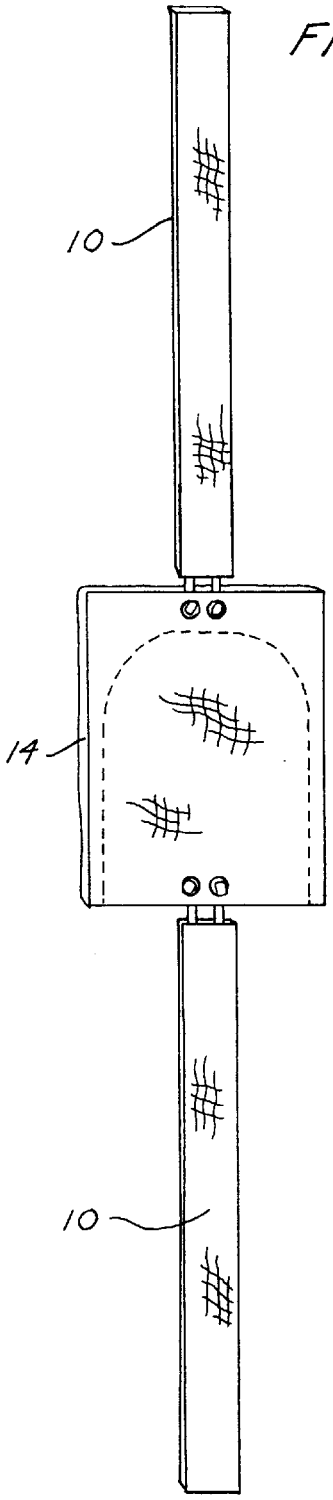
FIG. 2 is an assembled diagrammatic perspective view of the applicator system with interchangeable heads of the instant invention.

In the embodiment shown in FIG. 1, the receiving means comprise a pair of eyelets 16 at each end 14E of the attachment head 14, for receiving the hooks 12 which are disposed upon the attachment end 10A of each strap handle 10, so as to result in assembly as seen in FIG. 2. The assembly is employed by a user (having a pair of hands 22) holding one of the strap handles 10 about the grasping end 10G with one of the user's hands 22 and holding the other strap handle 10 about the grasping end 10G with the user's opposite hand 22. The user then initiates a reciprocating, stroking motion of the attachment head 14 upon a desired region of the user's body.

Figure 3:
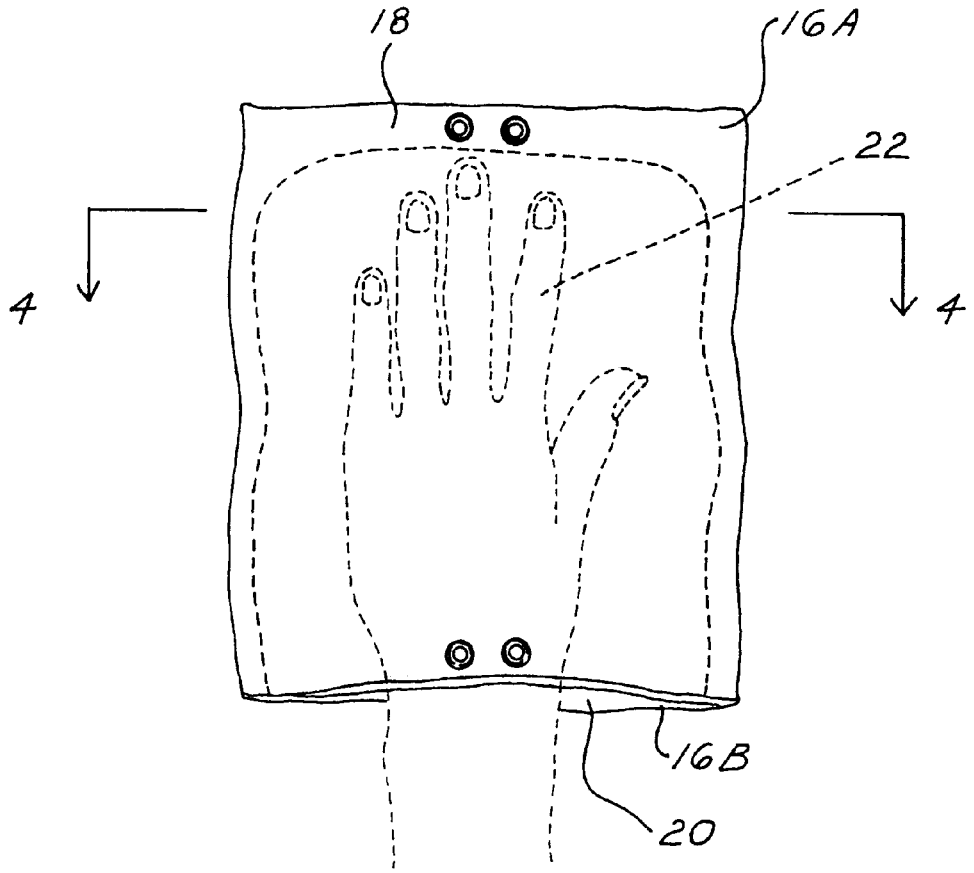
FIG. 3 illustrates one of the interchangeable heads of the instant invention being employed independently as a wash cloth.
Figure 4:
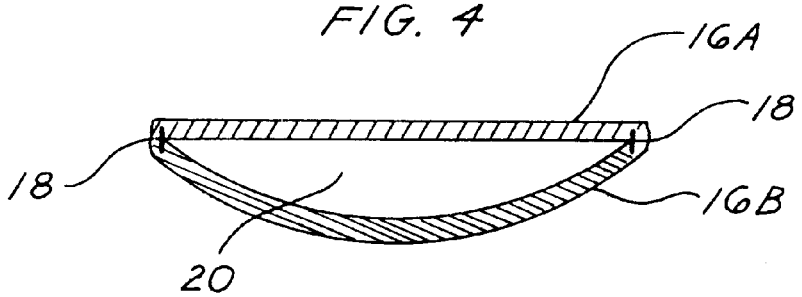
FIG. 4 is a cross-section taken on line 4—4 of FIG. 3.

The attachment head 14 which is used for illustrative purposes in FIGS. 1 and 2 can be seen in greater detail in FIGS. 3 and 4. There it can be seen that this first embodiment of said head 14 consists of a rectangular independent segment of cloth 16A and a convex head backing plate 16B, each having four sides and being substantially similar in size and shape. The rectangular independent segment of cloth 16A is joined to the convex head backing plate 16B by stitching 18 or similar joining means. This manner of joining creates a pouch cavity 20 into which the user's hand 22 may be inserted. Accordingly, when this embodiment is disengaged from the strap handles 10 and the user's hand 22 inserted into the pouch cavity 20, it may be used independently as a wash mitt.

What is claimed is:

1. An applicator system with interchangeable heads for washing, scrubbing and applying lotions to various regions of a user's body, the user having a pair of hands, the system comprising:

a) two elongated strap handles, each of said strap handles having an attachment end and an opposite grasping end, said elongated strap handles comprised of a pliable material such that they may be rolled-up for compact storage;

b) attachment means, located at each of the attachment ends of the elongated strap handles; and c) an attachment head, said attachment head detachably secured to the attachment means of the elongated strap handles and further having contoured surfaces for allowing a user to stimulate, wash and apply lotions to typically inaccessible regions of the body; the attachment head consists of a rectangular independent segment of cloth and a convex head backing plate, each having four sides and being substantially similar in size and shape, the rectangular independent segment of cloth joined to the convex head backing plate by stitching, thus defining a pouch cavity, said attachment head further having opposite ends and receiving means located at each of said opposite ends for allowing the attachment means of the respective strap handles to engage each of the receiving means, wherein the user holds the grasping end of one of the strap handles in one of the user's hands, and the other grasping end of the other strap handle in the user's opposite hand and initiates a reciprocating stroking motion of the attachment head upon a desired region of the user's body to wash, massage or apply lotion to said region, and the user may additionally disengage the strap handles from the attachment head, insert his hand into the pouch cavity and independently employ said disengaged attachment head as a hand applicator.

2. The applicator system with interchangeable heads of claim 1, wherein the receiving means which are located at each of the opposite ends of the attachment head comprise eyelets, and the attachment means which are located at the attachment ends of the strap handles comprise hooks which correspond in position to the eyelets of the attachment head.

* * * * *